US010145555B2

(12) United States Patent
Ohai

(10) Patent No.: US 10,145,555 B2
(45) Date of Patent: Dec. 4, 2018

(54) LIGHT FIXTURE

(71) Applicant: Jeffrey Ohai, Riverside, CA (US)

(72) Inventor: Jeffrey Ohai, Riverside, CA (US)

( * ) Notice: Subject to any disclaimer, the term of this patent is extended or adjusted under 35 U.S.C. 154(b) by 164 days.

(21) Appl. No.: 15/091,767

(22) Filed: Apr. 6, 2016

(65) Prior Publication Data

US 2017/0292693 A1 Oct. 12, 2017

(51) Int. Cl.

| | |
|---|---|
| ***F21V 31/00*** | (2006.01) |
| ***F21V 15/02*** | (2006.01) |
| *F21V 1/00* | (2006.01) |
| *F21V 3/06* | (2018.01) |

(52) U.S. Cl.

CPC ..... *F21V 31/005* (2013.01); *F21V 15/02* (2013.01); *F21V 1/00* (2013.01); *F21V 3/061* (2018.02)

(58) Field of Classification Search

None

See application file for complete search history.

(56) References Cited

U.S. PATENT DOCUMENTS

| | | | | |
|---|---|---|---|---|
| 1,882,312 | A | 10/1932 | Aspinwall | |
| 1,985,582 | A | 12/1934 | Schwinger | |
| 2,111,357 | A | 3/1938 | Cornell, Jr. | |
| 2,446,736 | A | 8/1948 | Biller | |
| 5,584,559 | A | 12/1996 | Toda | |
| 5,690,424 | A | 11/1997 | Warshauer et al. | |
| 5,845,882 | A | 12/1998 | Hodges et al. | |
| 6,538,201 | B1 | 3/2003 | Gretz | |
| 6,547,413 | B2 | 4/2003 | Hung | |
| 6,679,620 | B2 | 1/2004 | Patz et al. | |
| 7,401,950 | B2 | 7/2008 | Larouche | |
| 8,556,477 | B2 | 10/2013 | Ohai | |
| 8,628,224 | B1 * | 1/2014 | Speidel | F21V 17/164 362/277 |
| 8,777,449 | B2 * | 7/2014 | Van De Ven | F21S 8/02 362/249.02 |
| 2004/0165394 | A1 | 8/2004 | Pusch | |
| 2005/0270772 | A1 * | 12/2005 | Poon | F21L 4/00 362/186 |
| 2012/0092881 | A1 | 4/2012 | Ohai | |
| 2012/0195041 | A1 * | 8/2012 | Fletcher | F21V 15/01 362/249.02 |
| 2012/0275163 | A1 * | 11/2012 | Chen | F21V 23/009 362/294 |

* cited by examiner

*Primary Examiner* — Sharon Payne

(74) *Attorney, Agent, or Firm* — Kenneth L. Green; Averill & Green

(57) ABSTRACT

A Cast Guard Unit (CGU) light fixture is suitable for dry and wet areas and seals a wiring cavity using a single O-Ring. A cylindrical projection of the CGU center telescopingly engages a cylindrical cavity in the CGU top to varying depth and flanges on the CGU center and CGU top sandwich a light shade. The engagement of the cylindrical projection into the cylindrical cavity is free to vary to accommodate varying thicknesses of various light shades. The O-Ring resides between the cylindrical projection and the cylindrical cavity sealing the wiring cavity.

19 Claims, 5 Drawing Sheets

LIGHT FIXTURE

BACKGROUND OF THE INVENTION

The present invention relates to light fixtures and in particular to a moisture sealed light fixture.

Lighting fixtures used in wet areas are preferably sealed to prevent moisture from entering the fixture and corroding exposed electrical elements. For example, U.S. Pat. No. 2,813,9780 for "Lighting Unit" discloses a wet area light fixtures including a shade 41 held (or sandwiched) between a canopy 10 and a flange 14. Two gaskets 46 and 50 sandwich the light shade 41 presenting two failure modes, one for each gasket. Further, the gaskets 46 and 50 are both exposed to the elements, accelerating their potential for failure in harsh environments. When one of the gaskets fails, moisture can enter a wiring cavity of the lighting fixture resulting in corrosion and ultimately failure. The gradual corrosion may further increase resistance between electrical connections in the wiring cavity creating heat and a potential risk of fire.

BRIEF SUMMARY OF THE INVENTION

The present invention addresses the above and other needs by providing a Cast Guard Unit (CGU) light fixture which is suitable for dry and wet areas and seals a wiring cavity using a single O-Ring. A cylindrical projection of the CGU center telescopingly engages a cylindrical cavity in the CGU top to varying depth and flanges on the CGU center and CGU top sandwich a light shade. The engagement of the cylindrical projection into the cylindrical cavity is free to vary to accommodate varying thicknesses of various light shades. The O-Ring resides between the cylindrical projection and the cylindrical cavity sealing the wiring cavity.

In accordance with one aspect of the invention, there is provided a CGU light fixture accommodating varying thickness light shades. The CGU light fixture includes a telescoping engagement of the CGU center and CGU top providing a sealed wiring cavity regardless of the thickness of the light shade.

In accordance with one aspect of the invention, there is provided a CGU light fixture sealed by a single O-Ring. The O-Ring resides between the cylindrical projection and the cylindrical cavity sealing the wiring cavity.

BRIEF DESCRIPTION OF THE SEVERAL VIEWS OF THE DRAWING

The above and other aspects, features and advantages of the present invention will be more apparent from the following more particular description thereof, presented in conjunction with the following drawings wherein.

Corresponding reference characters indicate corresponding components throughout the several views of the drawings.

DETAILED DESCRIPTION OF THE INVENTION

The following description is of the best mode presently contemplated for carrying out the invention. This description is not to be taken in a limiting sense, but is made merely for the purpose of describing one or more preferred embodiments of the invention. The scope of the invention should be determined with reference to the claims.

Where the terms "about" or "generally" are associated with an element of the invention, it is intended to describe a feature's appearance to the human eye or human perception, and not a precise measurement.

Figure 2:
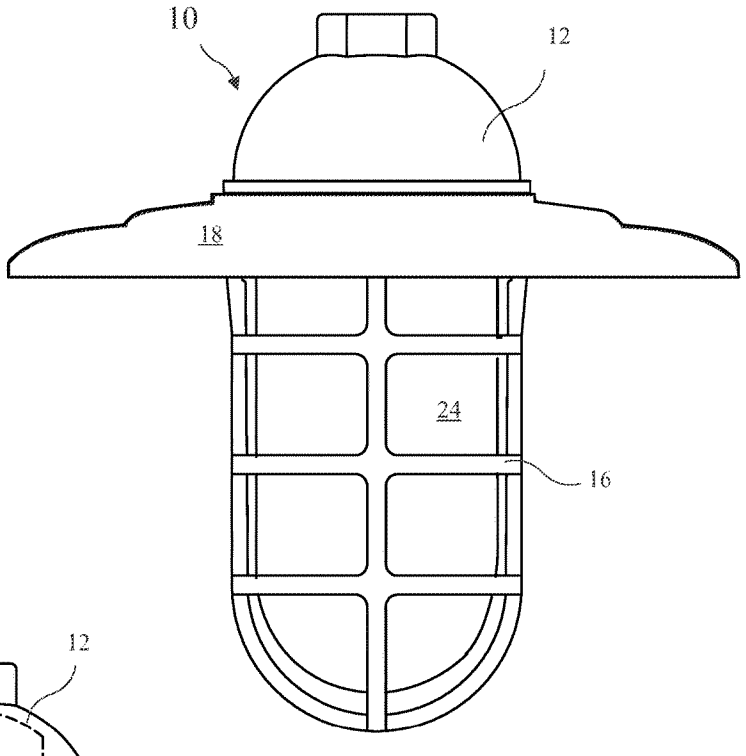
FIG. 2 shows a compete CGU light fixture including a light shade according to the present invention.
Figure 1:
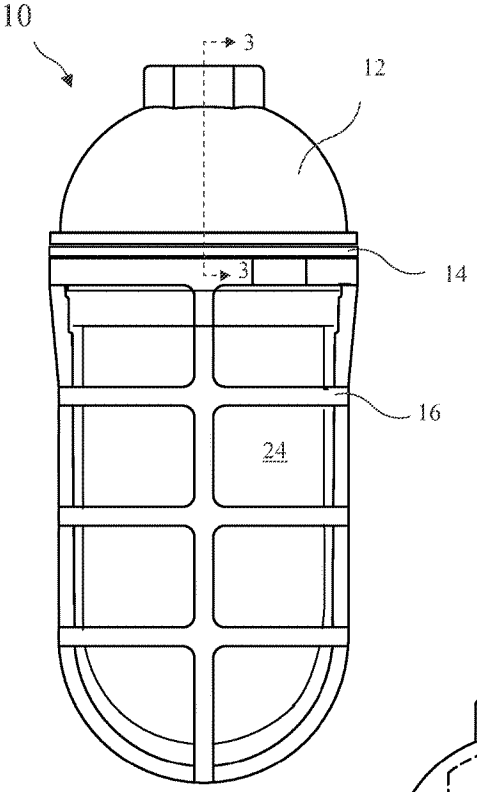
FIG. 1 shows a Cast Guard Unit (CGU) top, A CGU center, a light guard, and a glass light enclosure according to the present invention.

A Cast Guard Unit (CGU) top 12, A CGU center 14, a light guard 16, and a glass light enclosure 24 are shown in FIG. 1 and a compete CGU light fixture 10 including a light shade 18 is shown in FIG. 2. The CGU top 12 and CGU center 14 sandwich the light shade 18.

Figure 3:
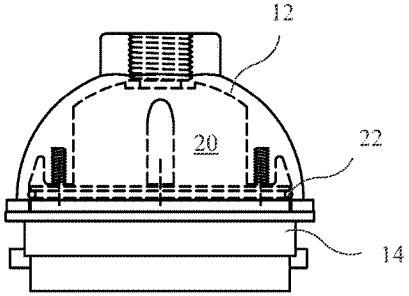
FIG. 3 shows a cross-sectional view of the CGU top and CGU center according to the present invention taken along line 3-3 of FIG. 1.
Figure 4:
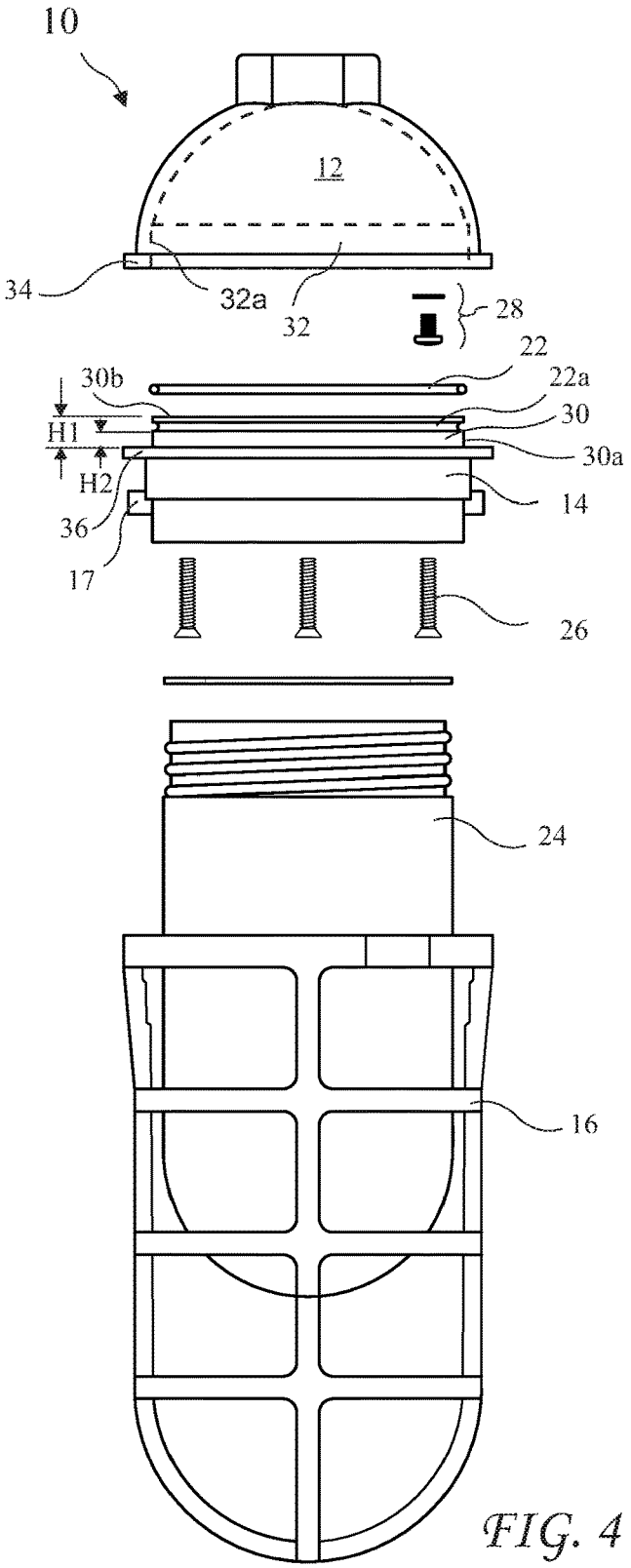
FIG. 4 shows an exploded view of the CGU light fixture according to the present invention.

Across-sectional view of the CGU top 12 and CGU center 14 taken along line 3-3 of FIG. 1 are shown in FIG. 3 and an exploded view of the CGU light fixture 10, excluding the light shade 18, is shown in the FIG. 4. The CGU top 12 includes a downwardly open cylindrical cavity 32 having a cavity interior wall 32*a* and a top flange 34 at the bottom of the downwardly open cylindrical cavity 32. The CGU center includes an upward reaching cylindrical projection 30 having a top end 30*b* and a cylindrical outer surface 30*a* which enters the downwardly open cylindrical cavity 32 when the CGU light fixture 10 is assembled. The upward reaching cylindrical projection 30 includes a center flange 36 at the bottom of the upward reaching cylindrical projection 30 limiting entry of the upward reaching cylindrical projection 30 into the downwardly open cylindrical cavity 32. The upward reaching cylindrical projection 30 telescopingly engages the downwardly open cylindrical cavity 32 when the CGU light fixture 10 is assembled. An O-Ring 22 residing in an O-Ring groove 22*a* on the outside of the upward reaching cylindrical projection 30 seals the engagement of the upward reaching cylindrical projection 30 telescopingly and the downwardly open cylindrical cavity 32 to seal a wiring cavity 20 in the CGU top 12. Screws 26 draw the CGU center 14 to the CGU top 12 causing the center flange 36 and top flange 34 to sandwich the light shade 18 (see FIG. 2). Light shades 18 are made of varying thickness material and the telescoping engagement of the CGU center 14 and CGU top 12 accommodates the varying thickness, with the O-Ring 22 sealing the wiring cavity 20 regardless of the thickness of the light shade 18. A ground screw and washer 28 attach inside the wiring cavity 20. Lugs 17 on the CGU center 14 are provided to attachment of the light guard 16 to the CGU center 14.

The upward reaching cylindrical projection 30 has a height H1 and the O-Ring groove 22*a* is a height H2 above the flange 36. The height H1 is preferably between ¼ and ½ inches, and more preferably about 0.35 inches. The height H2 is preferably between 0.15 and 0.25 inches and more preferably at least 0.2 inches and most preferably about 0.2 inches.

Figure 5:
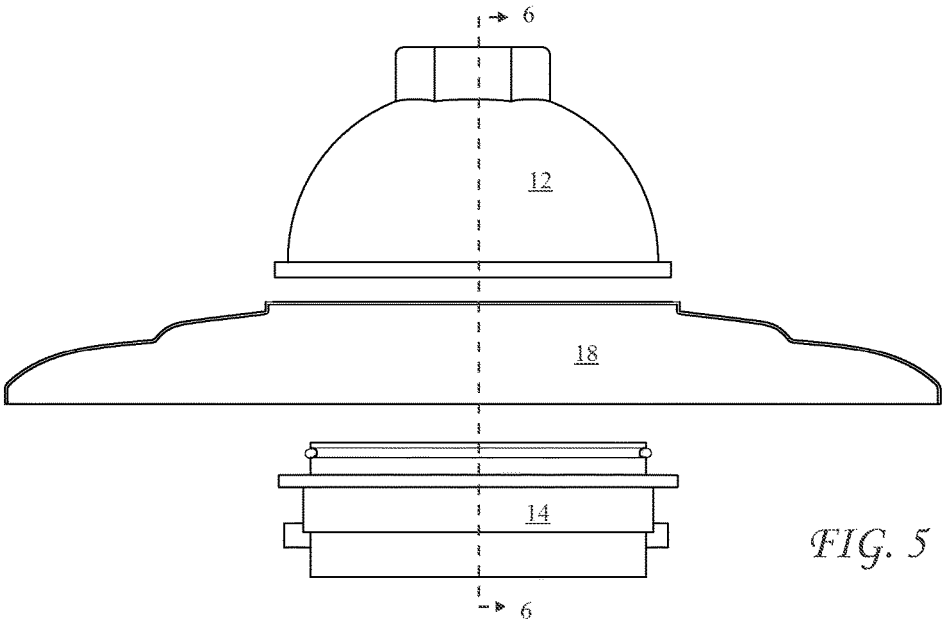
FIG. 5 shows the CGU top CGU center, and light shade according to the present invention.
Figure 6:
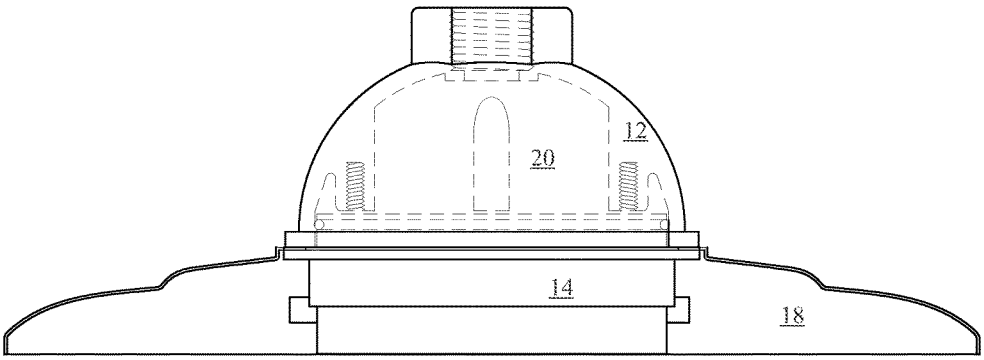
FIG. 6 shows a cross-sectional assembled view of the CGU top CGU center, and light shade according to the present invention taken along line 6-6 of FIG. 5.

The CGU top 12, CGU center 14, and light shade 18 shown before assembling in FIG. 5 and a cross-sectional assembled view of the CGU top 12, CGU center 14, and light shade 18 taken along line 6-6 of FIG. 5 are shown in FIG. 6.

Figure 8:
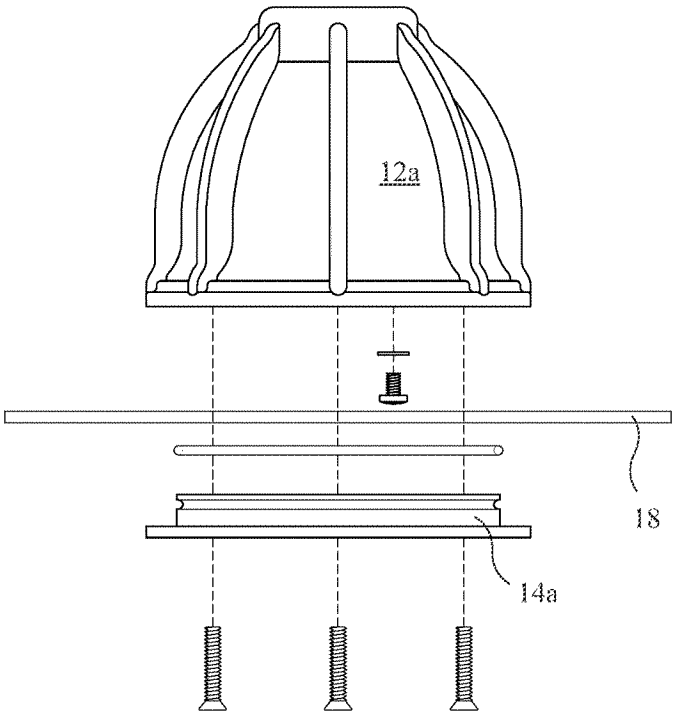
FIG. 8 shows a second CGU top and center separated and a portion of the light shade, according to the present invention.
Figure 7:
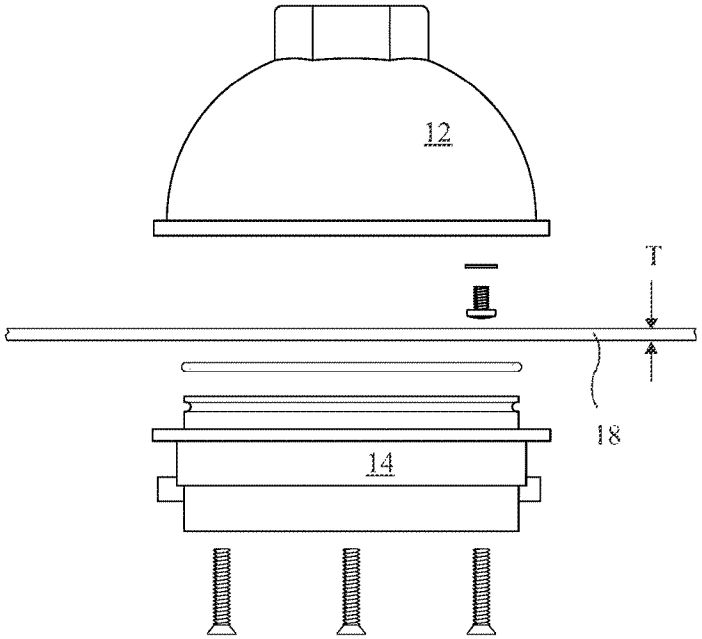
FIG. 7 shows the CGU top and center separated and a portion of the light shade, according to the present invention.

The CGU top 12 and center 14 separated, and a portion of the light shade 18, are shown in FIG. 8 and a second CGU top 12*a* and a second center 14*a* separated, and a portion of the light shade 18, are shown in FIG. 8. The light shade 18 has a thickness T between 0 and 0.125 inches.

Figure 9A:
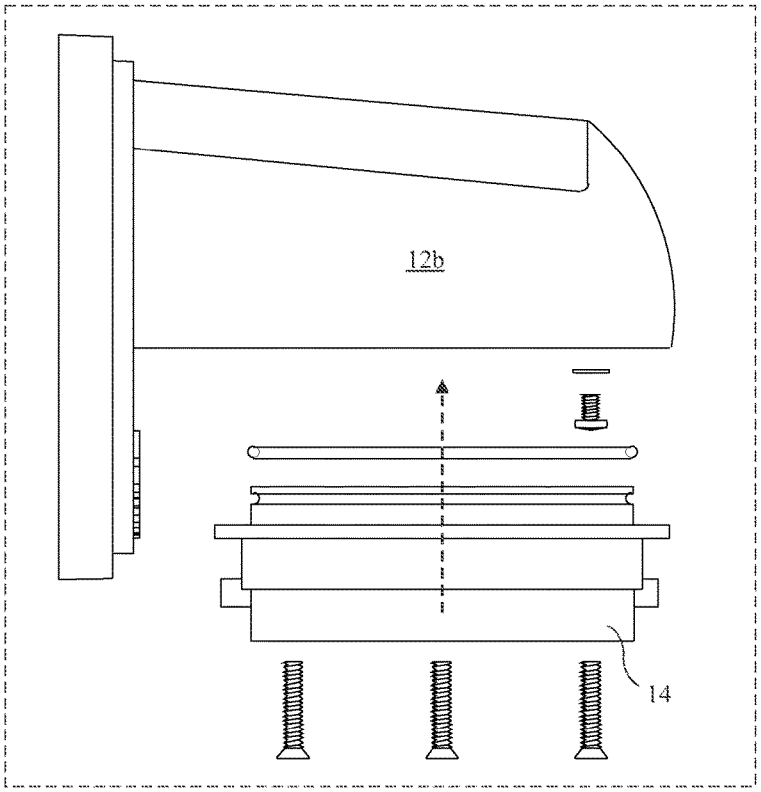
FIG. 9A shows a third CGU top and center, according to the present invention, separated.
Figure 9B:
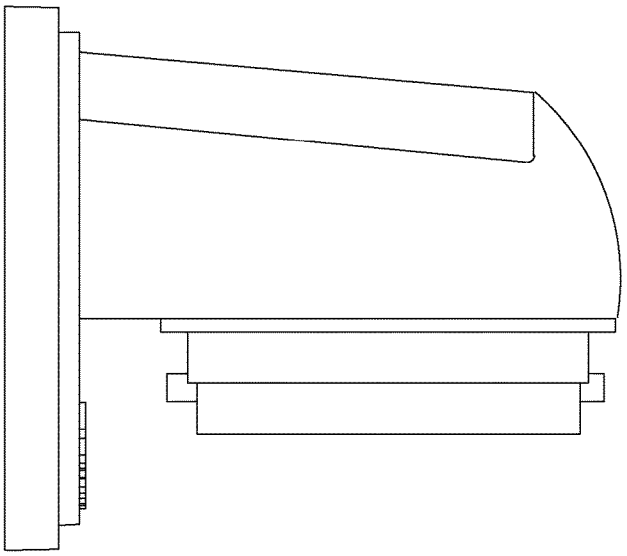
FIG. 9B shows a third CGU top and center according to the present invention, assembled.

A third CGU top 12*c* and the center 14 are shown separated in FIG. 9A and attached in FIG. 9B. Those skilled in the art will recognized that various light fixtures may include an upward reaching cylindrical projection cooperating with 143/092 downwardly open cylindrical cavity to seal a wiring cavity, and any light fixture so sealed is intended to come within the scope of the present invention.

While the invention herein disclosed has been described by means of specific embodiments and applications thereof, numerous modifications and variations could be made thereto by those skilled in the art without departing from the scope of the invention set forth in the claims.

I claim:

1. A Cast Guard Unit (CGU) light fixture comprising: a CGU top including: a bottom; a downward open cylindrical cavity having a cavity interior wall reaching up from the bottom into the CGU top; and a wiring cavity above the downward open cylindrical cavity; a CGU center including: an upward cylindrical projection having a cylindrical outer wall and a top end and configured to telescopingly enter the downward open cylindrical cavity of the CGU top; and a center flange at a projection base of the upward cylindrical projection, the center flange aligned with the CGU top when the upward cylindrical projection resides in the downward open cylindrical cavity; and an O-Ring captured below the top end of the upward cylindrical projection and radially sandwiched between the cylindrical outer wall and the cavity interior wall sealing the wiring cavity, for varying sealing engagement of the upward cylindrical projection with the downward open cylindrical cavity, wherein the CGU center slidably engages the CGU top and the O-Ring provides a seal between the upward cylindrical projection and the downward open cylindrical cavity for varying depths of insertion of the upward cylindrical projection into the downward open cylindrical cavity to accommodate varying thickness light shades held between the center flange of the upward cylindrical projection and the downward open cylindrical cavity.

2. The light fixture of claim 1, wherein the O-Ring resides in an O-Ring groove in the cylindrical outer wall circling the upward cylindrical projection below the top end of the upward cylindrical projection.

3. The light fixture of claim 2, wherein the O-Ring groove is between 0.15 and 0.25 inches above the center flange.

4. The light fixture of claim 3, wherein the O-Ring groove is about 0.2 inches above the center flange.

5. The light fixture of claim 1, wherein:

a light shade is sandwiched between the center flange and CGU top; and the depth of entry of the upward cylindrical projection into the downward open cylindrical cavity is reduced by the thickness T of the light shade.

6. The light fixture of claim 5, wherein:

the CGU top includes a top flange reaching radially out from the bottom of the CGU base; and the light shade is sandwiched between the center flange and CGU top flange.

7. The light fixture of claim 1, wherein the upward cylindrical projection has a height H of between ¼ and ½ inches.

8. The light fixture of claim 4, wherein the upward cylindrical projection has a height H of about 0.35 inches.

9. The light fixture of claim 1, wherein the CGU center is attached to the CGU top by generally vertical screws residing inside the upward cylindrical projection.

10. The light fixture of claim 1, further including a light guard attached to the CGU center below the center flange.

11. The light fixture of claim 5, further including a glass light enclosure attached to the CGU center below the center flange and residing inside the light guard.

12. The light fixture of claim 1, further including a light shade having a thickness T sandwiched between the top flange and the center flange, the thickness T varying the engagement of the upward cylindrical projection into the downward open cylindrical cavity.

13. A Cast Guard Unit (CGU) light fixture comprising:

a CGU top including: a bottom; a top flange around the bottom; a downward open cylindrical cavity having a cavity interior wall reaching up from the bottom into the CGU top; and a wiring cavity above the downward open cylindrical cavity; a CGU center including: a upward cylindrical projection having a cylindrical outer wall and a top end and configured to enter the downward open cylindrical cavity of the CGU top through the bottom of the CGU top;

a center flange at a projection base of the upward cylindrical projection, the center flange limiting the depth of insertion of the upward cylindrical projection into the downward open cylindrical cavity; and an O-Ring groove in the cylindrical outer wall of the CGU center at least 0.2 inches above the center flange and below the top end of the CGU center; and an O-Ring captured by the O-Ring groove and sandwiched radially between the upward cylindrical projection and the downward open cylindrical cavity sealing the wiring cavity, for varying engagement of the upward cylindrical projection and the downward open cylindrical cavity, wherein the CGU center slidably engages the CGU top and the O-Ring provides a seal between the upward cylindrical projection and the downward open cylindrical cavity for varying depths of insertion of the upward cylindrical projection into the downward open cylindrical cavity to accommodate varying thickness light shades held between the center flange of the upward cylindrical projection and the downward open cylindrical cavity.

14. A Cast Guard Unit (CGU) light fixture comprising:

a CGU top including: a base; a downward open cylindrical cavity reaching up through the base and into the CGU top; a top flange reaching radially out from the base of the downward open cylindrical cavity; and a wiring cavity above the downward open cylindrical cavity; a CGU center including: a upward cylindrical projection having a top end and configured to enter the downward open cylindrical cavity of the CGU top;

a center flange at a projection base of the upward cylindrical projection, the center flange aligned with the top flange when the upward cylindrical projection resides in the downward open cylindrical cavity; and an O-Ring groove circling the upward cylindrical projection between the center flange and the top end of the CGU center; an O-Ring captured by the O-Ring groove and radially sandwiched between the upward cylindrical projection and the downward open cylindrical cavity sealing the wiring cavity, for varying engagement of the upward cylindrical projection and the downward open cylindrical cavity; and a light shade sandwiched between the center flange and the top flange, the thickness of the Sight shade determining the depth of insertion of the upward cylindrical projection into the downward open cylindrical cavity, wherein the CGU center slidably engages the CGU top and the O-Ring provides a seal between the upward cylindrical projection and the downward open cylindrical cavity for varying depths of insertion of the upward cylindrical projection into the downward open cylindrical cavity to accommodate varying thickness light shades held between the center flange of the upward cylindrical projection and the downward open cylindrical cavity.

15. The light fixture of claim 1, wherein the CGU center is a single piece CGU center.

16. The light fixture of claim 13, wherein the CGU center is a single piece CGU center.

17. The light fixture of claim 14, wherein the CGU center is a single piece CGU center.

18. The light fixture of claim 13, wherein the CGU center slidably engages the CGU top and the O-Ring provides a seal between the upward cylindrical projection and the downward open cylindrical cavity for varying depths of insertion of the upward cylindrical projection into the downward open cylindrical cavity to accommodate varying thickness light shades held between the center flange of the upward cylindrical projection and the top flange of the downward open cylindrical cavity.

19. The light fixture of claim 14, wherein the CGU center slidably engages the CGU top and the O-Ring provides a seal between the upward cylindrical projection and the downward open cylindrical cavity for varying depths of insertion of the upward cylindrical projection into the downward open cylindrical cavity to accommodate varying thickness light shades held between the center flange of the upward cylindrical projection and the top flange of the downward open cylindrical cavity.

* * * * *